United States Patent [19]

Hall et al.

[11] Patent Number: 4,470,771

[45] Date of Patent: Sep. 11, 1984

[54] QUADRAPLEX FLUID PUMP

[75] Inventors: Richard W. Hall; Sven Sonnenberg, both of Springfield, Ohio

[73] Assignee: Towler Hydraulics, Inc., Urbana, Ohio

[21] Appl. No.: 409,781

[22] Filed: Aug. 20, 1982

[51] Int. Cl.[3] ..... F04B 17/00

[52] U.S. Cl. ..... 417/342; 417/346

[58] Field of Search ..... 417/342, 346, 344, 345, 417/341

[56] References Cited

U.S. PATENT DOCUMENTS

| | | |
|---|---|---|
| 2,463,552 | 3/1949 | Newhall . |
| 2,819,835 | 1/1958 | Newhall . |
| 3,011,444 | 12/1961 | Hobson . |
| 3,077,838 | 2/1963 | Maglott . |
| 3,201,031 | 8/1965 | Maglott . |
| 3,234,882 | 2/1966 | Douglas et al. . |
| 3,234,883 | 2/1966 | Douglas et al. . |
| 3,650,638 | 3/1972 | Cole . |
| 3,773,438 | 11/1973 | Hall et al. . |
| 3,847,511 | 11/1974 | Cole . |
| 3,967,542 | 7/1976 | Hall et al. . |
| 3,981,622 | 9/1976 | Hall et al. . |
| 3,994,627 | 11/1976 | Calzolari . |

*Primary Examiner*—Richard E. Gluck

*Attorney, Agent, or Firm*—Biebel, French & Nauman

[57] ABSTRACT

A quadraplex pumping unit for use as a mud pump, an intensifier, or as a pump for abrasive fluids or the like includes four rams and four ram operating pistons. A control valve arrangement provides for pressure equalization and energy transfer from a cylinder which has just extended in a working stroke to a companion cylinder which has just returned to its retracted to rest position, to conserve energy and reduce the thermal burden on the hydraulic system. The valve arrangement further provides for prepressurization, after pressure equalization, prior to an extending stroke.

5 Claims, 1 Drawing Figure

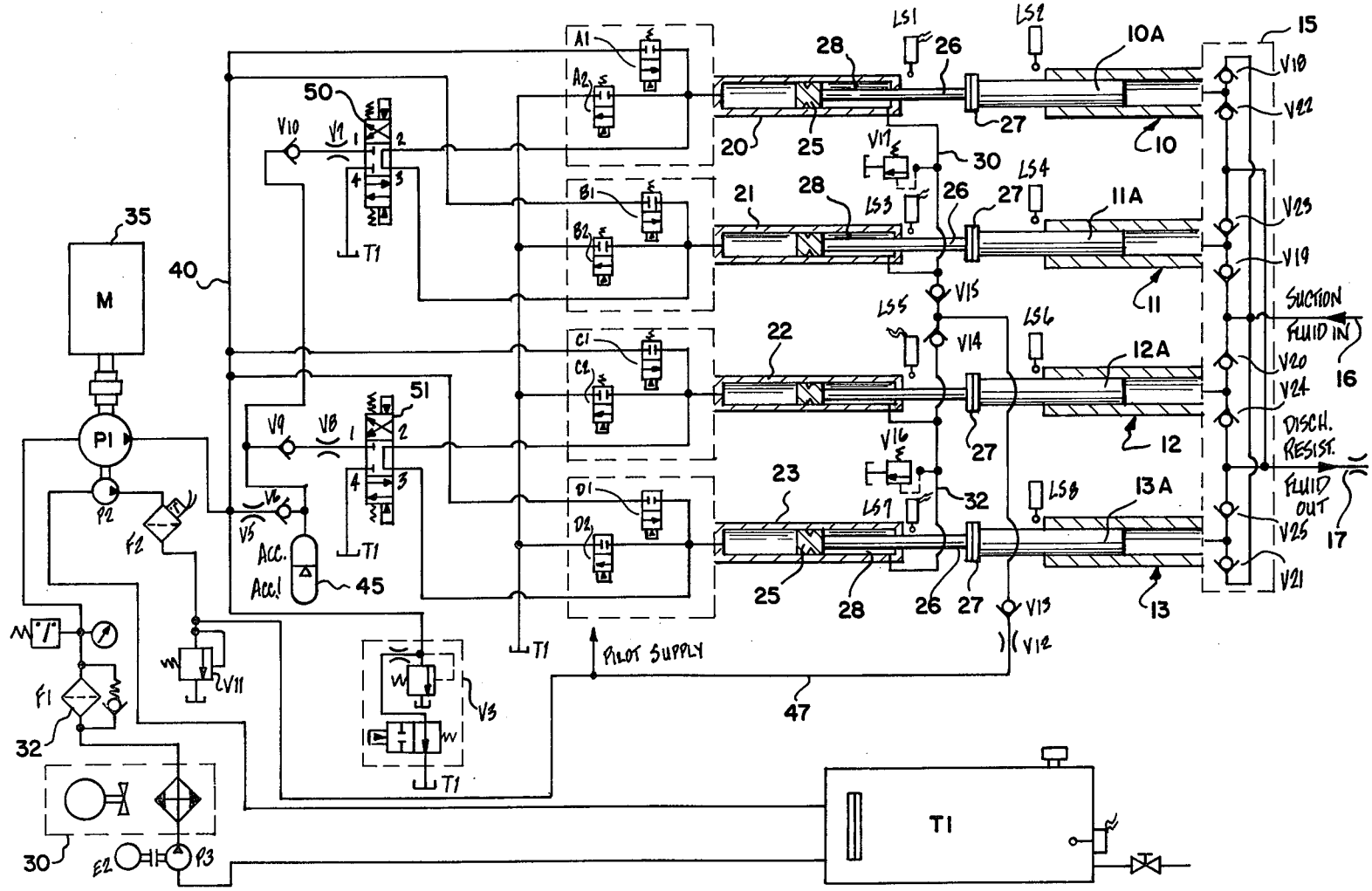
SUCTION FLUID IN
DISCH. RESIST. FLUID OUT
PILOT SUPPLY
Acc.
Acc.
M
P1
T1

QUADRAPLEX FLUID PUMP

BACKGROUND OF THE INVENTION

Multiple piston oil well stimulation and service devices, such as mud pumps or intensifiers and detensifiers are known. Two ram duplex pumping apparatuses are shown in the patents of Hall, et al, U.S. Pat. No. 3,773,438 of Nov. 20, 1973 and U.S. Pat. No. 3,967,542 of July 6, 1976, and a control for a duplex pump is shown in Hall, U.S. Pat. No. 3,981,622 of Sept. 22, 1976.

A characteristic of a typical oil well high-pressure pumping unit resides in the fact that when one of the ram drive cylinders has completed its forward or working stroke, the very high pressure hydraulic fluid behind the driving piston is released or dumped into the reservoir or tank. While the resultant loss of energy may not seem to be significant when compared to the total amount of energy expended by these large units, the fact is that it can amount to about 2% of the total energy being used, and this can be significant in self-contained systems in which the hydraulic fluid operates through a closed path. In such closed hydraulic systems the unspent or unused energy in the form of heat must be removed from the hydraulic fluid to prevent the same from overheating.

The oil well pumps of the general kind described are commonly operated in regions in which the ambient temperatures may be rather high. Thus, a self-contained system must contain sufficient cooling apparatus and capacity to prevent the hydraulic fluid from exceeding a predetermined maximum temperature. Above this temperature the seals and other parts, as well as the oil, are subject to rapid deterioration. Generally, the desired operating temperature is considered to be about 150° F. The life of the seals is particularly critical, since any kind of operation which shortens or reduces the life of the hydraulic seals substantially increases the likelihood of a premature overhaul or seal change, an expensive and time consuming operation during which time the equipment is idle. The problem of lost energy in the form of heat is further aggrevated by the fact that, in most locations, cooling water is not available, and expensive air operated heat exchangers must be used. The differential temperature, for the purpose of cooling, during mid-day operation, can be rather narrow.

SUMMARY OF THE INVENTION

The present invention is directed to a four piston oil well pumping unit, which may be adopted for use as a mud pump, or it may be used as an intensifier or a detensifier. The unit, however, is not limited to the oil well industry and it may be used for placing or moving slurries or liquid materials, in general, such as coal dust slurries or concrete.

Four hydraulic drive cylinders are respectively connected to operate four fluid ram units, in two pairs of two cylinder-ram combinations. In other words, pairs of cylinders are interconnected in such a manner that when the piston in one is moving forwardly the other is moving rearwardly. This is accomplished by interconnecting the cylinder annulus of each of the cylinders in each pair so that forward movement is accompanied by the retracting movement of the other at substantially the same rate.

The invention includes a precompression-decompression energy saving control valve for each of the interconnected pairs of cylinders. The control valve functions to transfer the stored energy contained in the cylinder which has just completed its stroke, by interconnecting the same to its paired cylinder which has not yet begun its stroke. In this manner, the energy contained in the highly pressurized hydraulic fluid within the large capacity of the extended cylinder is not wasted by dumping the same back to the tank, but is conserved by applying such energy to the opposite cylinder, which is in its retracted position, to partially precompress the fluid in that cylinder.

The precompression-decompression valve arrangement also has the function of connecting such partially precompressed cylinders to line pressure from an accumulator to complete precompression to provide a quadraplex fluid pump which has uniform suction and discharge characteristics. One of the four cylinders are always moving in one direction while the other of its pair is moving in the opposite direction. Utilizing the compressed fluid of one of a pair of fluid cylinders to precompress a further cylinder prior to admitting the pressure from the pump, not only saves energy, which would otherwise be converted to heat, but reduces hydraulic shock when full pressure is applied to the system.

It is accordingly an important object of this invention to provide a four cylinder hydraulic pumping unit in which pairs of the cylinders are interconnected to each other, and further including a control valve for prepressurizing one cylinder of each pair from the hydraulic fluid contained under pressure in the other cylinder of the pair, at the conclusion of each stroke.

A further advantage of the invention is the provision of a quadraplex pumping unit in which four hydraulic pistons and four associated pumping rams or cylinders work at a lower cycling rate than that of a comparable duplex or triplex system, thereby extending the life of the cylinders, as well as the life of the seals.

Another object of the invention is the provision of a control valve for operating a four cylinder pumping unit in which energy is saved by applying the stored energy of a just extended cylinder to a just retracted cylinder.

A further object of the invention is the provision of a pumping unit in which a separate control valve for each pair of two cylinders provides for pressure equalization and for prepressurization from a source of high pressure.

These and other objects and advantages of the invention will be apparent from the following description, the accompanying drawings, and the appended claims.

BRIEF DESCRIPTION OF THE DRAWING

The drawing represents a schematic diagram of the invention.

DESCRIPTION OF THE PREFERRED EMBODIMENT

Referring to the single FIGURE of the drawing, four identical fluid rams are illustrated by the reference numerals 10, 11, 12 and 13. For the purpose of this invention, rams 10 and 11 may be considered as a first pair of fluid rams, and rams 12 and 13 as a second pair of fluid rams. The rams are connected to a common header or outlet section 15, by means of which fluid is brought in through a suction line 16 and discharged under pressure through a fluid outlet line 17. The header 15 includes one way valves or isolation check valves arranged with the outlets of each of the fluid pressure rams to control the flow of liquid into or out of the ram cvlinders, which include valves V-18 and V-22 associated with ram 10, valves V-19 and V-23 associated with ram 11, valves V-20 and V-24 associated with ram 12, and valves V-21 and V-25 associated with the outlet of ram 13. The rams 10 through 13 each include working ram pistons 10*a*–13*a*.

The movements of the ram working pistons are controlled by hydraulic drive cylinders comprising cylinders 20, 21, 22 and 23 connected respectively with the rams 10, 11, 12 and 13. Cylinders 20 and 21 comprise one pair, and 22 and 23 comprise a second pair. Each of the cylinders 20–23 includes an internal piston 25 and a connecting or piston rod 26 which is directly connected to its respective ram piston through a coupling 27. The rods 26, in their respective cylinders, form annulus spaces 28 forward of the piston 25. The annulus spaces 28 of each of the above-defined piston pairs are connected in common, and thus the annulus spaces 28 of the cylinders 20 and 21 are connected in common by a line 30, and the corresponding respective annulus spaces in the cylinders 22 and 23 are connected by a line 32. The innerconnection of the annulus spaces 28 of the cylinders assures that when one piston 25 is moving outwardly or in a forward direction, the displacement of fluid from its annulus space is transmitted to the annulus space of the companion or paired cylinder, so that the piston of that cylinder is moving rearwardly or retracting at the same rate.

The forward or extended position of each of the cylinders is defined by limit switches LS-2, LS-4, LS-6, and LS-8, respectively, for the rams 10, 11, 12 and 13, while the retracted positions of these same cylinders is sensed respectively by limit switches LS-1, LS-3, LS-5 and LS-7.

The primary application of motive force to the cylinders 20, 21, 22 and 23 is applied through a valve control circuit from a common source of hydraulic fluid under pressure. The details of the source include a hydraulic oil supply tank T-1 from which a super-charging pump P-3 delivers hydraulic fluid at approximately 150 pounds pressure to the inlet of a primary engine driven pump P-1. A heat exchanger 30 is interposed in the line between pump P-3 and pump P-1 for removing excessive heat from the hydraulic fluid.

The pump P-1 is driven by an engine 35, which may be a diesel engine, or turbine engine or the like, to provide the necessary energy input into the system. For example, the engine driven pump may have as little as 100 hp or up to 4,000 hp or more, to provide an output which may have a pressure of up to 10,000 psi, as controlled by a pressure relief and by-pass valve assembly V-3.

The output of the pump P-1 is applied to a common line 40. A precharging accumulator 45 receives hydraulic fluid pressure from the pump P-1 through an orifice V-5 and a check valve V-6.

A pilot supply of lower pressure fluid is provided by a smaller pump P-2, driven from the primary pump P-1, and provides pressure for actuation of the hydraulic valves, at approximately 500 psi. It also provides for make-up fluid along a line 47 and through a restrictor V-12 and a check valve V-13 to the junction of the interconnecting lines 30 and 32 through isolation check valves V-14 and V-15.

The energy saving decompression and precompression valves are illustrated at 50 and at 51. These valves are identical in structure and function, and operate to interconnect the respective pairs of cylinders 20 and 21 (valve 50) and 22 and 23 (valve 51), to provide for the partial precompression of one cylinder of a pair from the stored energy in the other cylinder of that pair. Hydraulic fluid under extreme pressure is selectively applied to each of the cylinders from line 40 through on/off control valves A-1, B-1, C-1 and D-1, while discharge from the cylinders 20–23 to the tank T-1 is through a corresponding set of controllable discharge valves A-2, B-2, C-2 and D-2.

The operation of the invention will be understood from the following description. As noted, the primary pump P-1 can vary in size from a relatively small horsepower of approximately 100 hp to a pumping unit up to 4,000 hp or more, but for the purposes of the present description it may be considered as having a nominal power input of approximately 1,000 hp. This pump commonly has the capacity of providing an output pressure of as high as 10,000 psi or higher. This pressure can either be intensified or detensified by the cylinder and ram combinations. For example, oil field requirements often require an increase or an intensification of pressure such as for use in oil well fracturing, or may require a lower output pressure at higher volumes as in the case of mud pumps.

The primary pump P-1 is supplied from a supercharging source which includes a pump P-3. The pump P-3 receives hydraulic fluid from the storage tank T-1 and applies this fluid to the primary pump P-1 at 150 psi, for example, through a heat exchanger 30 and a filter 32. As noted above under "Background", frequently the operation of oil well hydraulic eouipment is limited by the ability effectively to control the maximum temperature of the hydraulic fluid. An air cooled heat exchanger 30 is shown, which typically must be used where water cooling is not reasonably available. Since the heat exchanger 30 must use air at ambient conditions, it is important that the hydraulic system not be unduly burdened with unnecessary wasted energy in the form of heat.

The hydraulic fluid from the principal or main pump P-1 is fed to the common line 40 to the valves A-1, B-1, C-1 and D-1. A small amount of fluid is bled from the pump P-1 to the accumulator 45 through the check valve V-6 and the restrictor V-5. The fluid from the accumulator is applied to the valves 50 and 51 respectively through check valves V-10, V-9 and flow control orifices V-7, V-8.

The valves 50, 51 are preferably three position, solenoid pressure operated, and each have four ports which are correspondingly numbered on the drawing. Port 1 receives precompession fluid from the accumulator 45, ports 2 and 3 are connected respectively to the cylinders 20 and 21 in the case of valve 50 (for cylinders 22 and 23 in the case of valve 51), and port 4 is connected to tank T-1. When the valve 50 or 51 is in the center position shown, the ports 1 and 4 are blocked and ports 2 and 3 are interconnected.

The valves 50 and 51 have the function of interconnecting cylinders 21, 22 and 22, 23 respectively, for pressure balancing, and provide precompression and decompression in accordance with a desired control sequence. The valves 50 and 51 are shown in the neutral position in which the cylinder pairs are interconnected. This interconnection of the cylinders allows for the compressed fluid in one cylinder to balance with the fluid in the other cylinder. In further explanation, assume rams 10 and 12 are retracted, resting respectively on limit switches LS-1 and LS-5, while rams 11 and 13 are extended, resting on limit switches LS-4 and LS-8. The pump P-1 is by-passing through the relief and by-pass valve V-3 under a controlled pressure. The pilot pump P-2 is being relieved through its pressure relief valve V-11 at an intermediate pressure of 500 psi, for example. The control valves 50 and 51 are de-energized in their center position as shown, and all two-way valves A, B, C and D are considered to be in their flow-blocking or closed positions, as shown.

The cycle is started by suitably pressing a start button on a control panel or in a control circuit. Valve 50 is energized so as to connect port 1 to port 2, and port 3 to port 4. This connects the inlet of cylinder 20 to high pressure through port 2 and connects the inlet to cylinder 21 to the tank through parts 3, 4. Valve 51 is energized at the same time to connect port 1 to port 2 and port 3 to port 4, thus connecting the inlet to cylinder 22 to high pressure and the inlet to cylinder 23 to the tank. It is also assumed that rams 10 and 12 are retracted and rams 11 and 13 are extended.

Valve V-3 is now energized to close off the internal relief valve and prevent by-passing. Also, valves A-1, B-2 and D-2 are operated. This causes the following: The pump P-1 delivers fluid to the piston of hydraulic cylinder 20 directly through valve A-1, and pressure will build up in the hydraulic cylinder 20 according to the resistance of the fluid pressure at ram 10 and the ratios of diameters. The cylinder rod 26 of the cylinder 20 will begin to extend, carrying with it the plunger 10*a* of the ram 10. As the annulus space 28 of the hydraulic cylinder 20 is interconnected with the corresponding annulus space at the cylinder 21, and as the control valve to the tank is open through valve B-2, the piston within the cylinder 21 will begin a retraction stroke at the same speed that the piston within the cylinder is extending.

While this is taking place, flow from the pump P-1 will be bled through orifice V-5 and check valve V-6 into the accumulator 45. The flow to the accumulator is also connected to valves 50 and 51 through check valves V-9 and V-10 and flow restrictor valves V-7 and V-8. As valves 50 and 51 are connected port 1 to port 2, flow will admit through check valve V-9 and orifice V-8 from the accumulator 45 into the hydraulic cylinder 22, thus prepressurizing the hydraulic cylinder 22 substantially to the system working pressure. The same flow will also be connected to the check valve V-10 associated with the three-way valve 50. However, the check valve V-10 will remain closed due to the pressure balance from the main pressure system at the primary pump P-1 being felt on the opposite side of the check valve V-10 from the hydraulic cylinder 20 to port 2 of the valve 50. In this condition, the ram 10 is moving forward, ram 11 is retracting at the same speed, the cylinder 22 for ram 12 is prepressurized, the cylinder 23 of ram 13 is connected to tank, and pressure and volume are being bled into the accumulator 45 through V-6.

As the piston in the hydraulic cylinder 21 retracts, the connector 27 will contact limit switch LS-3. This limit switch thus signals that the hydraulic cylinder 21 has in fact returned due to the interconnection of its annulus with the cylinder 20.

When the connector 27 of the hydraulic cylinder 20 reaches the extreme forward limit of its stroke, it will contact limit switch LS-2 and the following events occur in the following sequence:

(a) valve C-1 opens and cylinder 22 starts to extend;
(b) valve A-1 closes;
(c) valve B-2 closes;
(d) valve 50 moves to neutral center position connecting port 2 to port 1 for transfer of stored energy of cylinder 20 into cylinder 21, and a built-in time delay is initiated.

The above-identified valve sequences results in the following hydraulic cylinder movements:

(a) hydraulic cylinder 22 starts to extend;
(b) hydraulic cylinder 23 begins to retract at the same rate as hydraulic cylinder 22 extends;
(c) hydraulic cylinder 20 rests at its extended position;
(d) hydraulic cylinder 21 rests at its retracted position;

With hydraulic cylinder 20 fully stopped, cylinder 21 will pressure balance with 20 due to the interconnection of these cylinders through ports 2 and 3 of valve 50.

The initiated time delay may be relatively short, such as 100 milliseconds. After this time, sufficient to provide for pressure balancing and associated energy conservation thereby, valve 50 is energized to its down or cross-connecting position to connect port 1 to port 3 and port 2 to port 4 and a second short time delay is initiated. In its cross connected position, valve 50 now applies pressure from the accumulator 45 to cylinder 21, and cylinder 21 will be prepressurized close to the system working pressure, and at the same time, the extended cylinder 20 will now be fully decompressed to the tank through valve 50, ports 2 and 4.

At the conclusion of a second time delay, which may be approximately equal to the first time delay noted above, valve A-2 opens venting the cylinder 20 directly to the tank and by-passing valve 50. In the above condition, the hydraulic cylinder 22 is extending and hydraulic cylinder 23 is retracting at the same speed, while hydraulic cylinder 21 is precompressed close to the system working pressure and hydraulic cylinder 20 is now fully decompressed.

As hydraulic cylinder 23 retracts, it passes the limit switch LS-7, signalling that it is now retracted and that hydraulic cylinder 22 is fully extended, where it contacts limit switch LS-6 which operates the following valves in the following sequence:

(a) valve B-1 opens;
(b) valve C-1 closes;
(c) valve D-2 closes;
(d) valve 51 moves to its neutral position connecting port 2 to port 3, repeating a first time delay.

The above valve sequence results in the following hydraulic cylinder movements:

(a) hydraulic cylinder 21 begins to extend when valve B-1 opens connecting the hydraulic cylinder directly to the output of pump P-1;
(b) hydraulic cylinder 20 begins to retract at the same speed;
(c) hydraulic cylinder 22 is stopped in its extended position at limit switch LS-6;
(d) hydraulic cylinder 23 is fully retracted and at rest at its limit switch LS-7.

After this sequence is completed, the hydraulic cylinder 23 is interconnected with cylinder 22 through valve 51 and the pressures therebetween are balanced, thus conserving the stored energy and pressure from cylinder 22 and applying the same to cylinder 23. After the second time delay for pressure balancing of say 100 milliseconds, valve 52 moves to its opposite cross-connecting position in which port 1 is connected to port 3 and port 2 is connected to port 4, starting a second time delay, for complete decompression of cylinder 22 to the tank, while the flow from port 1 to port 3 through valve 2 allows fluid pressure from the accumulator 45 to flow into hydraulic cylinder 23, thus raising the pressure in hydraulic cylinder 23 close to the system working pressure. At the conclusion of the second time delay valve C-2 opens, thus completing the cycle.

The continuous reciprocating movement as defined above assures that one fluid ram of the four rams is always moving on a pumping stroke and one of the fluid rams is always moving on a suction or a return stroke to provide uniform pumping and suction to the fluid being pumped. The operation of the decompression and precompression energy saving valves 50 and 51 provides a closed loop system in which the high energy stored in a just extended cylinder is transferred and pressure balanced with its corresponding pair, namely, a just retracted cylinder, rather than released to tank, which would otherwise release the energy in the form of heat.

The above-defined operational sequences may, of course, be performed manually, but preferably may be performed with a microprocessing controller within the ability of those skilled in the art. The saving in energy resulting in the transfer of energy from the extended cylinder to the retracted cylinder of each of the cylinder pairs, prior to full prepressurization, permits a savings in energy which substantially lowers the burden of the heat exchanger 30 and permits the maintenance of hydraulic fluid temperatures within normal ranges. The four ram pumping unit has further advantages over existing two ram and three ram systems in that since only one ram is moving on a working stroke at any one time, the wear is distributed through four essentially identical working systems, thus extending the time between overhauls and making the system comparatively more efficient economically.

While the form of apparatus, herein described constitutes a preferred embodiment of this invention, it is to be understood that the invention is not limited to this precise form of apparatus, and that changes may be made therein without departing from the scope of the invention.

What is claimed is:

1. In a pumping ram system including four pumping rams, and a separate hydraulic drive cylinder for each said ram, said drive cylinder having a pressure end and an annulus end, the improvement comprising:

a source of hydraulic fluid under high pressure, first valve means for admitting fluid from said source to the pressure end of each of said cylinders for effecting extension movement thereof, means interconnecting the annulus ends of pairs of said cylinders so that extension movement of one of said cylinders is accompanyied by retraction movement of the other cylinder of said pair at substantially the same rate, second valve means connected to the pressure end of said cylinders for permitting hydraulic fluid therein to be returned to a source of low pressure during retraction movement, an accumulator connected to said high pressure source providing a source of hydraulic fluid for prepressurization, and a three-way control valve for each of said cylinder pairs, each said control valve having one port connected to receive fluid from said accumulator, another port connected to discharge fluid to the low pressure fluid source, and further having ports connected to each of the associated pairs of said cylinders, each of said three-way control valves operable in one position to interconnect the pressure ends of its associated said cylinders for the purpose of pressure equalization providing for transfer of energy from a pressurized one of said cylinders of one pair to the other cylinder of said pair, and operative in a second position to apply the pressure from the accumulator to said other cylinder while venting said one cylinder to low pressure, and operative in a third position to apply pressure from the accumulator to said one cylinder while venting said other cylinder to low pressure.

2. In a four-piston pumping system, the improvement comprising:

a source of hydraulic fluid under high pressure, four cylinders each operating a pumping ram, each of said cylinders having a piston and an annulus region forward of said piston, means interconnecting the annulus regions of pairs of said cylinders so that extension movement in a working stroke of one cylinder is accompanied by retracting movement of the paired cylinder at substantially the same rate, means for selectively delivering fluid under high pressure from said high pressure source to each of the cylinders of the pumping system to cause said cylinders to move sequentially into an extended working stroke, means for selectively connecting each of said cylinders to a source of low fluid pressure providing for a retracting movement of the cylinders by discharge of fluid therein into said low pressure source, means for equalizing the pressure between a just extended cylinder and its paired just retracted cylinder for transferring stored energy from said extended cylinder to said retracted cylinder, including means for completing the prepressurization of said retracted cylinder prior to application of fluid pressure thereto from said high pressure source.

3. The system of claim 2 in which said means for equalizing includes:

an accumulator, means connecting said accumulator to said high pressure source, and valve means operable to connect said accumulator to a pressure equalized retracted cylinder.

4. The system of claim 3 in which said valve means is a three-way valve operable in one position to effect said pressure equalization and in a second position to effect said connection of said accumulator and in a third position to connect a previously depressurized cylinder to low pressure.

5. In a pumping ram system including four pumping rams, and a separate hydraulic drive cylinder for each of said rams, each said drive cylinder having a pressure end and an annulus end, the improvement comprising:

a source of hydraulic fluid under high pressure, first valve means for admitting fluid from said source to the pressue end of each of said cylinders for effecting extension movement thereof, means interconnecting the annulus ends of pairs of said hydraulic drive cylinders so that extension movement of one of said cylinders is accompanyied by retraction movement of the other cylinder of said pair at substantially the same rate, second valve means connected to the pressure end of said cylinders for permitting hydraulic fluid therein to be returned to a source of low pressure during retraction movement, an accumulator connected to said high pressure source providing a source of hydraulic fluid for prepressurization, and multiple position control valve means for each of said pairs, each said control valve means having one port connected to receive fluid from said accumulator, another port connected to discharge fluid to the low pressure fluid source, and further having ports connected to each of the associated pairs of said cylinders, each of said valve means operable sequentially to interconnect the pressure ends of said cylinder pairs providing for transfer of energy from a pressurized one of said cylinders of one pair to the cylinder of said pair, to apply the pressure from the accumulator to said other cylinder while venting said one cylinder to low pressure, and to apply pressure from the accumulator to said one cylinder while venting said other cylinder to low pressure.

* * * * *